US005342700A

United States Patent [19]

Arnaud et al.

[11] Patent Number: 5,342,700

[45] Date of Patent: Aug. 30, 1994

[54] STEEL WIRE HAVING A STRUCTURE OF A STRAIN-HARDENED LOWER BAINITE TYPE AND METHOD FOR PRODUCING SUCH WIRE

[75] Inventors: Jean-Claude Arnaud, Tourtoule; Bernard P. Prudence, Saint Maurice Sur Allier, both of France

[73] Assignee: Compagnie Generale Des Establissements Michelin-Michelin & Cie, Cedex, France

[21] Appl. No.: 861,846

[22] PCT Filed: Dec. 18, 1990

[86] PCT No.: PCT/FR90/00920

§ 371 Date: Jun. 17, 1992

§ 102(e) Date: Jun. 17, 1992

[87] PCT Pub. No.: WO91/09933

PCT Pub. Date: Jul. 11, 1991

[30] Foreign Application Priority Data

Dec. 22, 1989 [FR] France ..... 89 17227

[51] Int. Cl.[5] ..... B22B 15/06; B60C 9/00; C21D 8/06

[52] U.S. Cl. ..... 428/625; 428/677; 148/320; 148/598

[58] Field of Search ..... 148/532, 537, 595, 598, 148/320; 428/658, 659, 677, 607, 625; 152/451, 565; 57/902

[56] References Cited

U.S. PATENT DOCUMENTS

| | | | |
|---|---|---|---|
| 3,444,008 | 5/1969 | Keough | 148/598 |
| 3,666,572 | 5/1972 | Nakagawa et al. | 148/595 |
| 3,674,570 | 4/1972 | Hallstrom et al. | 148/12 |
| 4,250,226 | 2/1981 | Graham et al. | 152/451 |
| 4,563,222 | 7/1986 | Sugita et al. | 148/12 F |
| 4,578,124 | 3/1986 | Yutori et al. | 148/598 |
| 4,737,392 | 4/1988 | Dambre | 152/451 |

FOREIGN PATENT DOCUMENTS

| | | | |
|---|---|---|---|
| 138886 | 11/1979 | Fed. Rep. of Germany . | |
| 2488279 | 2/1982 | France | 148/598 |
| 53-56122 | 5/1978 | Japan | 148/598 |
| 53-89817 | 8/1978 | Japan | 148/598 |
| 60-245722 | 12/1985 | Japan | 148/598 |
| 2-166229 | 6/1990 | Japan | 148/598 |
| 449099 | 11/1974 | U.S.S.R. | 148/595 |

OTHER PUBLICATIONS

R. Hehemann, "Ferrous and NonFerrous Bainitic Structures", Metals Handbook, 8th ED. vol. 8, American Society for Metals, Metals Park, Ohio, 1983, pp.194–196.

Patent Abstracts of Japan, vol. 13, No. 42 (C-564) (3390), 30-01-89 & JP, A, 63241136 (Sumitomo Metal Ind) 06-10-88.

Patent Abstracts of Japan, vol. 3, No. 100 (C-56) (94) 24-08-79, & JP, A, 5479119 (Kobe Seikosho) 23-06-79 (cite dans la demande).

Stahl u. Eisen, vol. 70, No. 2, 10-01-50, A. Pomp et al.: Die Anwendbarkeit der isothermen Hartung bei der Herstellung unlegierter Stahldrahte:, voir p. 57.

*Primary Examiner*—John Zimmermann

*Attorney, Agent, or Firm*—Brumbaugh Graves Donohue & Raymond

[57] ABSTRACT

A metal wire having the following features:

(a) it is formed, at least in part, by a steel having a carbon content of at least 0.1% and at most 0.6% and a boron content of less than 8 ppm;

(b) the steel of the wire has a strain-hardened lower bainite type structure (7);

(c) the diameter of the wire varies from 0.10 to 0.40 mm;

(d) the resistance to rupture of the wire is at least equal to 2800 MPa;

(e) the elongation upon rupture of the wire is at least equal to 0.4%.

The method according to the invention for producing this wire consists in strain hardening a machine wire having 28% to 90% proeutectoid ferrite and 72% to 10% perlite, thereupon carrying out a heat treatment to obtain a structure of lower bainite type, then effecting a strain hardening on the wire, the temperature of the wire upon the strain hardening being less than 0.3 $T_F$, $T_F$ being the melting point of the steel expressed in Kelvin.

21 Claims, 1 Drawing Sheet

STEEL WIRE HAVING A STRUCTURE OF A STRAIN-HARDENED LOWER BAINITE TYPE AND METHOD FOR PRODUCING SUCH WIRE

BACKGROUND OF THE INVENTION

The present invention relates to metal wires and the processes of obtaining them. These wires are used, for instance, to reinforce articles of plastic or rubber, in particular tubes, belts, plies and automobile tires.

The wires of this type which are presently/currently used are formed of steel containing at least 0.6% carbon, this steel having a strain-hardened perlitic structure. The rupture strength of these wires is about 2800 MPa (megapascals); their diameter varies generally from 0.15 to 0.35 mm, and their elongation upon rupture is between 0.4 and 2%. These wires are made by drawing an initial wire, known as a "machine wire", the diameter of which is about 5 to 6 mm, the structure of this machine wire being a hard structure formed of perlite and ferrite with a high content of perlite, generally more than 72%. Upon the production of this wire, the drawing is interrupted at least once in order to carry out one or more heat treatments which make it possible to regenerate the initial structure.

This process has the following drawbacks:

the raw material is expensive, since the carbon content is relatively high;

the parameters cannot be easily modified; in particular, the diameter of the machine wire and the final diameter are maintained within strict limits, the process therefore lacking flexibility;

the great hardness of the machine wire due to its strongly perlitic structure makes drawing prior to the heat treatment difficult, so that the rate of deformation $\epsilon$ of this drawing is necessarily less than 3; furthermore, the speed of this drawing is low and there may be breaks of the wire upon this operation.

Furthermore, the wires themselves sometimes have insufficient resistance to rupture and their resistance to fatigue is limited, due probably to a damaging of these wires upon the drawing before the heat treatment as a result of the great hardness of the machine wire.

The Japanese patent application published under No. 54-79119 describes a process of preparing a boron steel wire of bainite structure by heating in a fluidized bed. The wires obtained have poor mechanical properties.

The object of the present invention is to propose a strain-hardened metal wire of non-perlitic structure having a resistance to rupture and an elongation upon rupture at least as high as the known strain-hardened perlitic steel wires, and less damage than the known wires.

Another object of the invention is to propose a process not having the aforementioned drawbacks for the production of this wire.

The metal wire in accordance with the invention has the following characteristics:

(a) it is formed at least in part by a steel having a carbon content of at least 0.1% and at most 0.6%, and a boron content of less than 8 ppm (parts per million);

(b) the steel of the wire has a strain-hardened lower bainite type structure;

(c) the diameter of the wire varies from 0.10 to 0.40 mm;

(d) the resistance to rupture of the wire is at least 2800 MPa;

(e) the elongation upon rupture of the wire is at least 0.4%.

The process of the invention for the production of this wire is characterized by the following features:

(a) a steel machine wire having a carbon content of at least 0.1% and at most 0.6% and a boron content of less than 8 ppm (parts per million) is strain-hardened, said steel comprising 28% to 90% proeutectoid ferrite and 72% to 10% perlite; the deformation ratio $\epsilon$ of this strain hardening being at least equal to 3;

(b) the strain hardening is stopped and a single structural heat treatment is carried out on the strain-hardened wire; this treatment consists in heating the wire to above the AC3 transformation point in order to impart it a homogeneous austenite structure, then cooling it rapidly to a temperature of between 350° C. and 450° C., the rate of this cooling being at least equal to 250° C./second, and maintaining it within this temperature range for a period of time of at least 30 seconds so as to obtain a structure of lower bainite type having carbide precipitates distributed practically uniformly in a ferrite matrix;

(c) the wire is cooled to a temperature below 0.3 $T_F$, $T_F$ being the melting point of the steel expressed in Kelvin;

(d) a strain hardening is carried out on the wire which has undergone this heat treatment, the temperature of the wire upon the strain hardening being less than 0.3 $T_F$, the deformation ratio e of this strain hardening being at least equal to 3.

The invention also concerns assemblies comprising at least one wire in accordance with the invention.

The invention also concerns articles reinforced at least in part by wires or assemblies in accordance with the above definitions, such articles consisting, for instance, of tubes, belts, plies and automobile tires.

The invention will be easily understood on basis of the following embodiments and the diagrammatic figures relating to these examples.

DESCRIPTION OF THE FIGURES IN THE DRAWING

DESCRIPTION OF PREFERRED EMBODIMENTS

Figure 1:
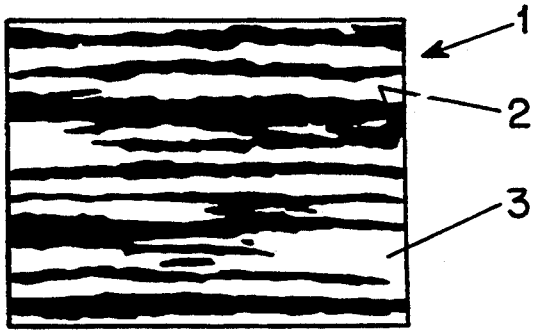
FIG. 1 shows the structure of the steel of a wire before heat treatment, upon the carrying out of the process of the invention.

In the following specification, all percentages and parts per million of composition indicated are parts by weight and the rupture resistance measurements and measurements of elongation at rupture are carried out in accordance with AFNOR method NFA 03-151.

By definition, the deformation ratio $\epsilon$ of a strain hardening is given by the formula $\epsilon = \mathrm{Ln}\,(So/Sf)$ being the neper logarithm, So being the initial cross section of the wire before the strain hardening, and Sf being the cross section of the wire after this strain hardening.

The object of the following examples is to describe the preparation and properties of three wires in accordance with the invention.

In these examples, a machine wire of a diameter of 5.5 mm which has not been strain-hardened is used. This machine wire is formed of a steel the properties of which are as follows:

| | |
|---|---|
| carbon content: | 0.4% |
| boron content: | less than 8 ppm; |
| manganese content: | 0.4%; |
| silicon content: | 0.2%; |
| phosphorus content: | 0.015%; |
| sulfur content: | 0.02%; |
| aluminum content: | 0.015%; |
| nitrogen content: | 0.005%; |
| chromium content: | 0.05%; |
| nickel content: | 0.10%; |
| copper content: | 0.10%; |
| molybdenum content: | 0.01%; |
| proeutectoid ferrite content: | 53%; |
| perlite content: | 47%; |
| melting point of the steel, $T_F$: | 1795 K |
| resistance to rupture $R_m$: | 700 MPa; |
| elongation at rupture $A_r$: | 17% |

Three wires in accordance with the invention are made with this machine wire in the following manner:

Example 1

The machine wire is descaled, coated with a drawing soap, for instance borax, and drawn dry so as to obtain a wire of a diameter of 1.1 mm, which corresponds to a deformation ratio $\epsilon$ of slightly more than 3.2.

The drawing is easily effected due to the relatively ductile structure of the machine wire. By way of example, a non-strain-hardened steel of 0.7% carbon has a resistance to rupture $R_m$ of about 900 MPa and an elongation at rupture of about 8%; in other words, it is definitely less ductile.

The drawing described above is effected at a temperature of less than 0.3 $T_F$; for purposes of simplification, although this is not indispensable, the drawing temperature may possibly be equal to or exceed 0.3 $T_F$.

FIG. 1 is a longitudinal section through a portion 1 of the structure of the wire thus obtained. This structure is formed of elongated blocks 2 of cementite and elongated blocks 3 of ferrite, the largest dimension of these blocks being oriented in the direction of drawing.

The following heat treatment is then carried out on the wire thus obtained:

the wire is heated to bring it to 900° C., that is to say above the AC3 transformation point, and it is held at this temperature for 1 minute so as to obtain a homogeneous austenite structure;

the wire is then cooled to 400° C. in a salt bath in less than 2 seconds, and then maintained at this temperature for 1 minute, whereupon it is cooled to about 20° C., that is to say to room temperature.

Figure 2:
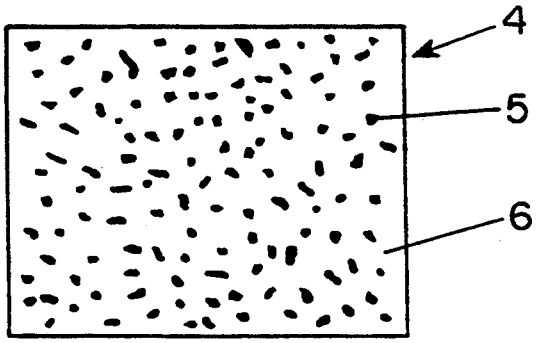
FIG. 2 shows the structure of the steel of a wire after heat treatment upon the carrying out of the process of the invention.

FIG. 2 is a section through a portion 4 of the structure of the wire thus obtained. This structure, of lower bainite type, is formed of carbide precipitates 5 distributed practically uniformly in a ferrite matrix 6. This structure is obtained by the preceding heat treatment and it is retained upon cooling to room temperature. The precipitates 5 generally are of sizes at least equal to 0.005 $\mu$m (micrometer) and at most equal to 0.5 $\mu$m.

The wire thus obtained by this thermal treatment and this cooling to room temperature is covered with a layer of brass. The thickness of this layer of brass is slight (on the order of $\mu$m) and is negligible as compared with the diameter of the wire before the brass coating. Wet drawing of this wire is then effected so as to obtain a final diameter of 0.2 mm, which corresponds practically to $\epsilon=3.4$. The wire drawing is facilitated by the layer of brass. The temperature of the wire upon this drawing is necessarily less than 0.3 $T_F$.

Figure 3:
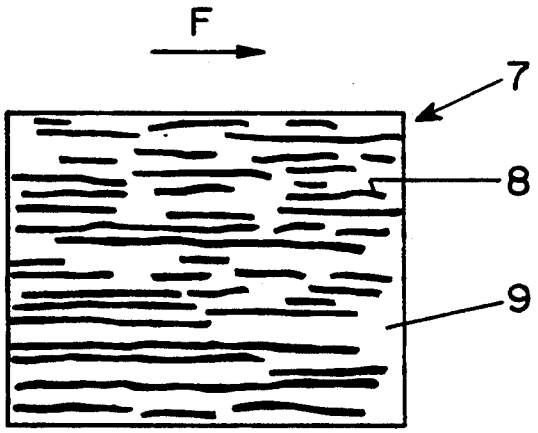
FIG. 3 shows the structure of the steel of a wire in accordance with the invention.

FIG. 3 is a longitudinal section through the portion 7 of this wire according to the invention which is thus obtained. This portion 7 has a structure of strain-hardened lower bainite type formed of carbides 8 of elongated shape which are practically parallel to each other and the largest dimension of which is oriented along the axis of the wire, that is to say along the direction of drawing indicated by the arrow F in FIG. 3. These carbides 8 are arranged in a strain-hardened ferrite matrix 9.

This wire in accordance with the invention has a resistance to rupture of 3200 MPa and an elongation upon rupture of 0.7%.

Example 2

The machine wire is descaled, coated with a layer of drawing soap, for instance borax, and drawn dry to obtain a wire of a diameter of 0.9 mm which corresponds to a deformation ratio $\epsilon$ slightly greater than 3.6. The structure obtained is analogous to that shown in FIG. 1. The following heat treatment is then carried out on the wire thus obtained:

the wire is heated in the same manner as in Example 1 so as to obtain a homogeneous austenite structure;

the wire is then cooled to 370° C. in less than 2 seconds and held at this temperature for 90 seconds, whereupon it is cooled to room temperature.

The structure obtained is similar to that shown in FIG. 2. The wire is then coated with brass and drawn in a manner similar to Example 1 so as to obtain a final diameter of 0.17 mm, which corresponds practically to $\epsilon=3.3$. The temperature of the wire upon this drawing is less than 0.3 $T_F$. The wire in accordance with the invention thus obtained has a structure similar to that shown in FIG. 3.

This wire has a resistance to rupture equal to 3000 MPa and an elongation upon rupture of 0.9%.

Example 3

A wire in accordance with the invention is produced in the same manner as in Example 1, but with the difference that the drawing carried out after the heat treatment is continued to a final diameter of 0.17 mm, which corresponds practically to $\epsilon=3.7$. This wire in accordance with the invention has a resistance to rupture equal to MPa and an elongation upon rupture equal to 0.7%. The intermediate structures and the final structure are similar to the structures previously described.

The invention has the following advantages:

one starts from a machine wire of low carbon content and therefore of low cost;

there is great flexibility with respect to the selection of the diameters of the wires; thus, for instance, one can use machine wires the diameter of which is substantially greater than 6 mm, which further reduces the cost, and wires of very different diameter can be produced;

the drawing before the structural heat treatment is relatively easy so that the deformation ratio e of this drawing can be greater than 3; furthermore, this drawing can be effected at high speeds; finally, the frequency of wire breaks and of changes of dies is reduced, which further decreases the cost;

the wire obtained has a resistance to rupture and an elongation upon rupture of values at least equal to those of conventional wires, which therefore results in an energy of rupture at least equal to that of the conventional wires;

the wire is less damaged upon the drawing before heat treatment;

the wire obtained has better resistance to corrosion than the conventional wires, as a result of its low carbon content.

The steel of the wire according to the invention preferably has a carbon content of at least 0.2% and at most 0.5%.

The steel of the wire according to the invention, and therefore the initial machine wire, preferably have the following composition: 0.3% ≦Mn≦0.6%; 0.1%≦Si≦0.3%; P≦0.02%; S≦0.02%; Al≦0.02%; N≦0.006%.

In the steel of the wire according to the invention and therefore in the initial machine wire, one advantageously has the following ratios: Cr≦0.06%; Ni≦0.15%; Cu≦0.15%; Mo≦0.015%.

In the process of the invention, one preferably has at least one of the following characteristics:

the initial machine wire has a carbon content of at least 0.2% and at most 0.5%;

the initial machine wire has a proeutectoid ferrite content of at least 41% and at most 78% and a perlite content of at least 22% and at most 59%;

the deformation ratio e upon the strain hardening before the structural heat treatment is at most equal to 6;

the deformation ratio e upon the strain hardening after the structural heat treatment is at most equal to 4.5.

In the examples described above, the wire was coated with brass after the heat treatment in order to facilitate its drawing, but the invention covers cases in which drawing materials other than brass are used, for instance copper, zinc and ternary, copper-zinc-nickel, copper-zinc-cobalt and copper-zinc-tin alloys, these materials being other than steel.

The strain hardening of the wire in the preceding examples is effected by drawing, but other techniques are possible, for instance rolling, possibly combined with a drawing, in the case of at least one of the strain hardening operations.

Of course, the invention is not limited to the embodiments described above.

We claim:

1. A metal wire characterized by the following features:

(a) it is formed, at least in part, of a steel having a carbon content of at least 0.1% and at most 0.6% and a boron content of less than 8 ppm (parts per million);

(b) the steel of the wire has a structure strain-hardened lower bainite;

(c) the diameter of the wire varies from 0.10 to 0.40 mm;

(d) the resistance to rupture of the wire is at least 2800 MPa;

(e) the elongation at rupture of the wire is at least 0.4%

2. A metal wire according to claim 1, characterized by the fact that the steel has a carbon content of at least 0.2% and at most 0.5%.

3. A metal wire according to claim 1, characterized by the fact that the steel satisfies the following relationships: 0.3%≦Mn≦0.6%; 0.1% ≦Si≦0.3%; P≦0.02%; S≦0.02%; Al≦0.02%; N≦0.006%.

4. A metal wire according to claim 3, characterized by the fact that the steel satisfies the following relationships: Cr≦0.06%; Ni≦0.15%; Cu≦0.15%; Mo≦0.015%.

5. A metal wire according to claim 1, characterized by the fact that it is coated with a metal layer other than steel.

6. A metal wire according to claim 5, characterized by the fact that it is coated with a layer of brass.

7. An assembly comprising at least one wire according to claim 1.

8. An article reinforced with at least one wire according to claim 1.

9. An article reinforced with at least one assembly according to claim 7.

10. An article according to claim 9, characterized by the fact that it is an automobile tire.

11. A method of producing a metal wire comprising the steps of:

(a) strain hardening a steel machine wire having a carbon content of at least 0.1% and at most 0.6% and a boron content of less than 8 ppm (parts per million), said steel comprising 28% to 90% proeutectoid ferrite and 72% to 10% perlite and the deformation ratio $\epsilon$ of the strain hardening being at least equal to 3;

(b) stopping the strain hardening and then carrying out a single structural heat treatment on the strain hardened wire; said heat treatment consisting of heating the wire to above the AC3 transformation point in order to impart to it a homogeneous austenite structure, then cooling it rapidly to a temperature of between 350° C. and 450° C. at a rate of at least 250° C./second, and maintaining the wire within this temperature range for a period of time of at least 30 seconds so as to obtain a material of lower bainite structure having carbide precipitates distributed practically uniformly in a ferrite matrix;

(c) cooling the wire to a temperature below 0.3 $T_F$, $T_F$ being the melting point of the steel expressed in Kelvin; and (d) carrying out a second strain hardening on the cooled wire while maintaining the temperature of the wire during the strain hardening at less than 0.3 $T_F$, the deformation ratio $\epsilon$ of the second strain hardening being at least equal to 3.

12. A method according to claim 11, characterized by the fact that the machine wire has a carbon content of at least 0.2% and at most 5%.

13. A method according to claim 11, characterized by the fact that the machine wire satisfies the following relationships: 0.3%≦Mn≦0.6%; 0.1%≦Si≦0.3%; P≦0.02%; S≦0.02%; Al≦0.02%; N≦0.006%.

14. A method according to claim 13, characterized by the fact that the machine wire satisfies the following relationships: Cr≦0.06%; Ni≦0.15%; Cu≦0.15%; Mo≦0.015%.

15. A method according to claim 11, characterized by the fact that a metal coating other than steel is effected on the wire after the structural heat treatment before strain hardening.

16. A method according to claim 15, characterized by the fact that said coating is a coating of brass.

17. A method according to claim 11, characterized by the fact that the machine wire has a proeutectoid ferrite content of at least 41% and at most 78% and a perlite content of at least 22% and at most 59%.

18. A method according to claim 11, characterized by the fact that the deformation ratio $\epsilon$ upon the strain hardening before the structural heat treatment is at least 3 and at most equal to 6.

19. A method according to claim 11, characterized by the fact that the deformation ratio $\epsilon$ upon the strain hardening after the structural heat treatment is at least 3 and at most 4.5.

20. A method according to claim 11, characterized by the fact that at least one strain hardening is effected, at least in part by drawing.

21. A method according to claim 11, characterized by the fact that the structure of lower bainite type obtained after the rapid cooling is such that the carbide precipitates have, in general, dimensions of at least 0.005 $\mu$m (micrometer) and at most 0.5 $\mu$m.

* * * * *

UNITED STATES PATENT AND TRADEMARK OFFICE

CERTIFICATE OF CORRECTION

PATENT NO. : 5,342,700

DATED : Aug. 30, 1994

INVENTOR(S) : Arnaud et al.

It is certified that error appears in the above-indentified patent and that said Letters Patent is hereby corrected as shown below:

Title page, Item 73, 3rd line, "Cedex" should read --Clermont -Ferrand Cedex--. First page, 2nd col., 7th line, "1983" should read --1973--. Col. 1, line 12, "presently/currently" should read --presently currently--. Col. 2, line 30, "e" should read --ε--; line 62, "being" should read -- , Ln being--. Col. 4, line 64, "e" should read --ε--. Col. 5, line 31, "e" should read --ε--. Col. 5, line 33, "e" should read --ε--; lines 56-57, "structure strain-hardened lower bainite" should read --strain-hardened lower bainite structure--. Col. 6, line 18, "claim 9" should read --claim 8--; line 52, "5%" should read --0.5%--.

Signed and Sealed this

Fourteenth Day of March, 1995

Bruce Lehman

*Attest:*

BRUCE LEHMAN

*Attesting Officer*

*Commissioner of Patents and Trademarks*